US007221081B2

(12) United States Patent
Baek

(10) Patent No.: US 7,221,081 B2
(45) Date of Patent: *May 22, 2007

(54) CATHODE RAY TUBE HAVING SPECIFIC PANEL DIMENSIONS

(75) Inventor: Jae Seung Baek, Daegukwangyuk-si (KR)

(73) Assignee: LG.Philips Displays Korea Co., Ltd., Gumi-si (KR)

( * ) Notice: Subject to any disclaimer, the term of this patent is extended or adjusted under 35 U.S.C. 154(b) by 261 days.

This patent is subject to a terminal disclaimer.

(21) Appl. No.: 10/938,605

(22) Filed: Sep. 13, 2004

(65) Prior Publication Data

US 2005/0116606 A1 Jun. 2, 2005

(30) Foreign Application Priority Data

Nov. 27, 2003 (KR) ..... 10-2003-0084814

(51) Int. Cl.
*H01J 29/86* (2006.01)
*H01J 29/92* (2006.01)

(52) U.S. Cl. ..... 313/477 R; 220/2.1 A

(58) Field of Classification Search ..... 313/461, 313/477 R, 474, 479; 335/210–214; 220/2.1 R, 220/2.3, 2.1 A, 2.3 A
See application file for complete search history.

(56) References Cited

U.S. PATENT DOCUMENTS 6,686,249 B1 * 2/2004 Yukinobu et al. ..... 438/328
2004/0051439 A1 * 3/2004 Kim et al. ..... 313/477 R
2004/0140752 A1 * 7/2004 Choi ..... 313/477 R
2004/0242396 A1 * 12/2004 Hachitani ..... 501/64
2005/0023954 A1 * 2/2005 Jung ..... 313/477 R

* cited by examiner

*Primary Examiner*—Joseph Williams
*Assistant Examiner*—Bumsuk Won
(74) *Attorney, Agent, or Firm*—Birch, Stewart, Kolasch & Birch, LLP

(57) ABSTRACT

The present invention relates to a color cathode ray tube and more specifically to a color cathode ray tube in which mechanical stress due to internal pressure made by evacuation is decreased. According to an aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein radius of curvature of outer surface of said panel is in the range of 5000 mm to 100000 mm, and said panel satisfies: $1.0 \leqq (OAH*CFT)/USD \leqq 1.5$ wherein OAH is overall height of said panel measured along defrection axis X, USD is diagonal length of effective screen of said panel and CFT is thickness of center portion of said panel. According to the present invention, a manufacturing cost is decreased by lightness of the cathode ray tube through variation of the panel and the funnel of the cathode ray tube, and the yield is improved by decrease of breakness of the cathode ray tube. Furthermore, by optimization of the structure of the panel and the funnel, the vacuum stress is decreased and the shockproof is improved. Furthermore, a bad effect to human body is prevented by interception of the X-ray.

26 Claims, 6 Drawing Sheets

(a)

(b)

CATHODE RAY TUBE HAVING SPECIFIC PANEL DIMENSIONS

This Nonprovisional application claims priority under 35 U.S.C. § 119(a) on Patent Application No. 10-2003-0084814 filed in Korea on Nov. 27, 2003, the entire contents of which are hereby incorporated by reference.

BACKGROUND OF THE INVENTION

1. Field of the Invention

The present invention relates to a color cathode ray tube and more specifically to a color cathode ray tube in which mechanical stress due to internal pressure made by evacuation is decreased.

2. Description of the Background Art

FIG. 1 shows a schematic diagram illustrating the structure of a general color cathode ray tube. As shown in FIG. 1, the color cathode ray tube generally includes a glass envelope having a shape of bulb and being comprised of a faceplate panel 1, a tubular neck 13, and a funnel 2 connecting the panel 1 and the neck 13.

The panel 1 comprises faceplate portion and peripheral sidewall portion sealed to the funnel 2. A phosphor screen 4 is formed on the inner surface of the faceplate portion. The phosphor screen 4 is coated by phosphor materials of R, G, and B. A multi-apertured color selection electrode, i.e., shadow mask 3 is mounted to the screen with a predetermined space. The shadow mask 3 is hold by main and sub frames 7 and 8. An electron gun is mounted within the neck 13 to generate and direct electron beams 6 along paths through the mask to the screen.

The shadow mask 3 and the frame 7 constitutes a mask-frame assembly. The mask-frame assembly is joined to the panel 1 by means of springs 9.

The cathode ray tube further comprises an inner shield 10 for shielding the tube from external geomagnetism and a reinforcing band 12 attached to the sidewall portion of the panel 10 to prevent the cathode ray tube from being exploded by external shock. The cathode ray tube further comprises external deflection yokes 5 located in the vicinity of the funnel-to-neck junction and a magnet 11 attached to the rear side of the deflection yokes 5 for amending electron bean trajectory.

Process for making the color cathode ray tube comprises generally pre-process and post-process. During the pre-process, phosphor materials are deposited on the inner surface of the panel.

The post-process comprises further sub processes as follows. Firstly, after the phosphor materials are deposited, sealing process is performed. In the sealing process, the panel 1 to which mask-frame assembly is mounted and the funnel 2 on the inner surface of which frit is deposited is sealed together in a high temperature furnace. Then, evacuating process is performed where electron gun is inserted in the neck 13. Thereafter, an evacuating and sealing process is performed, in which the cathode ray tube is evacuated and sealed.

Since the cathode ray tube is evacuated, it suffers from high tensile and compressive stress. Therefore, a reinforcing process is conducted where reinforcing band 12 is attached to the panel to distribute the stress over the panel.

FIG. 2 shows a schematic view of distributions of stresses generated in the panel and funnel glasses after the evacuation process. As shown in FIG. 2, stress is generated by pressure difference of inside and outside of the glass envelop because the inside of the glass is evacuated. The stress changes a shape of the glass because the stress is generated at the whole glass envelop. That is, compression stress is generated at the faceplate panel and backplate funnel. Accordingly the tensile stress is generated at conor portion of the panel 1 and sealing portion of the panel and the funnel 2. In FIG. 2, dotted and solid lines represent compressive and tensile stresses, respectively.

Meanwhile, when a glass get a shock from outside, cracks appear in the glass. Tensile stress may hasten increase of the cracks such that the glass may even be broken by the cracks. On the contrary, compressive stress disturb increase of the cracks. Central portion of the panel gets compressive stress while corner portion and seal line portion get tensile stress. Therefore, the central portion is relatively strong against shock. However, the corner portion and the seal line portion is easily broken by outside shock.

Moreover, as recently cathode ray tube becomes thin on account of wide and flat screen, the stress is generated seriously. That is, the stress is generated seriously by vacuum of the glass envelop because of slimness of the cathode ray tube, maintenance of vacuum grade of the inside of the glass envelop and decrease of volumn of the cathode ray tube. Furthermore, in a case of the cathode ray tube having rectangular neck for decreasing consumption power of the deflection yoke, the cathode ray tube has constructional defect by shape of the funnel. Therefore, because high tensile stress is generated, the cathode ray tube is easily broken in heat process.

In order to solve these problems, conventional art discloses method for reinforcing the glass envelop physically by generating the compression stress through decreasing tensile stress of the glass envelop stably and performing heat process for increasing shockproof. However, in the conventional art, high tensile remain stress is generated together with the compression stress on account of ununiform temperature distribution. Therefore, because the compression stress is limited to predetermined level, to decrease weight is limited.

Furthermore, X-ray is generated when the phosphor screen is lightened by the electron beam. The X-ray which penetrates through the faceplate panel have bad influence upon human body.

SUMMARY OF THE INVENTION

Accordingly, an object of the present invention is to solve at least the problems and disadvantages of the background art.

An object of the present invention is to provide a cathode ray tube where stress is effectively reduced and shock tolerance is achieved.

Another object of the present invention is to provide the cathode ray tube preventing the X-ray.

According to an aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein radius of curvature of outer surface of said panel is in the range of 5000 mm to 100000 mm, and said panel satisfies: $1.0 \leqq (OAH*CFT)/USD \leqq 1.5$ wherein OAH is overall height of said panel measured along defrection axis X, USD is diagonal length of effective screen of said panel and CFT is thickness of center portion of said panel.

According to another aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein radius of curvature of outer surface of said panel is in the range of 5000 mm to 100000 mm, and diagonal length of effective screen of said panel is in the range of 450 mm to 500 mm, and said panel satisfies: $1.0 \leqq (OAH*CFT)/USD \leqq 1.7$ where OAH is overall height of said panel measured along defrection axis X, USD is diagonal length of effective screen of said panel and CFT is thickness of center portion of said panel.

According to the present invention, a manufacturing cost is decreased by lightness of the cathode ray tube through variation of the panel and the funnel of the cathode ray tube, and the yield is improved by decrease of breakness of the cathode ray tube. Furthermore, by optimization of the structure of the panel and the funnel, the vacuum stress is decreased and the shockproof is improved. Furthermore, a bad effect to human body is prevented by interception of the X-ray.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
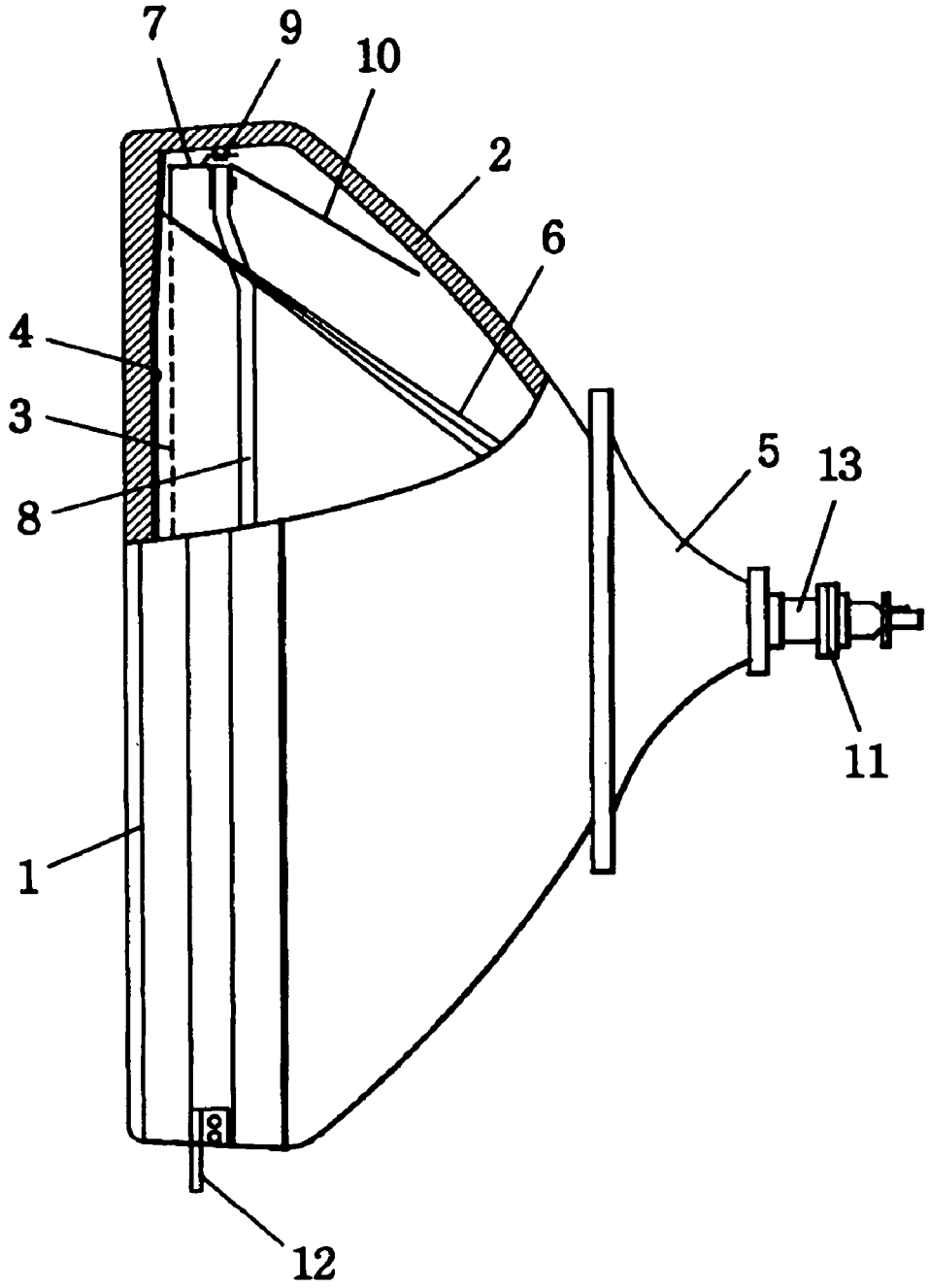
Fig. 1 Related Art
FIG. 1 shows a schematic diagram illustrating the structure of a general color cathode ray tube.
Figure 2:
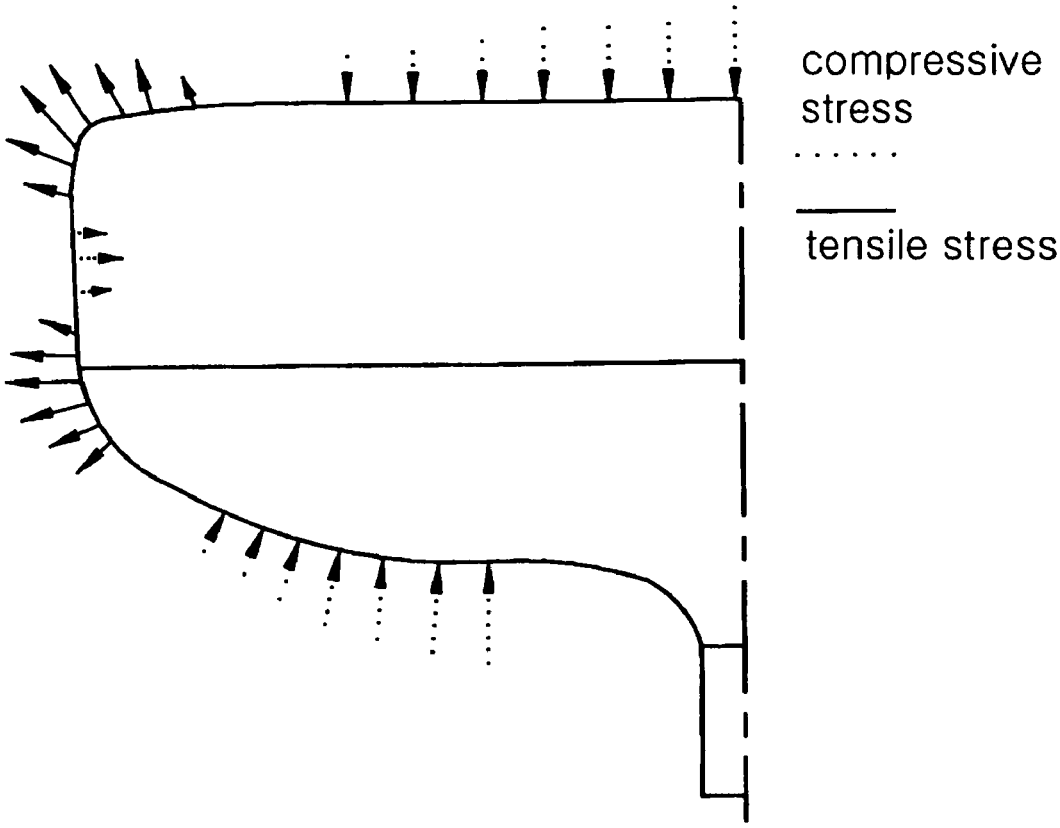
Fig. 2 Related Art
FIG. 2 shows a schematic view of distributions of stresses generated in the panel and funnel glasses after the evacuation process.
Figure 3:
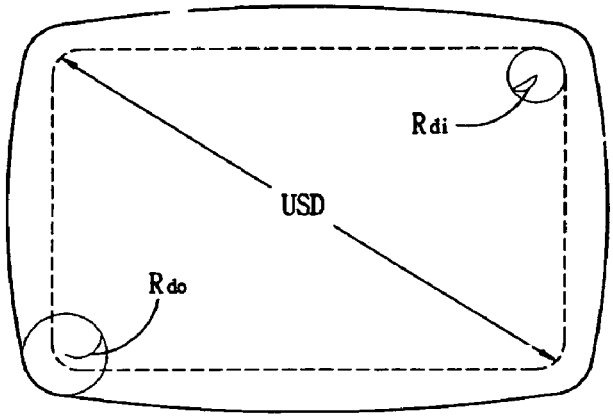
FIG. 3 shows a plane view and a cross-section view of panel according to the present invention.
Figure 3:
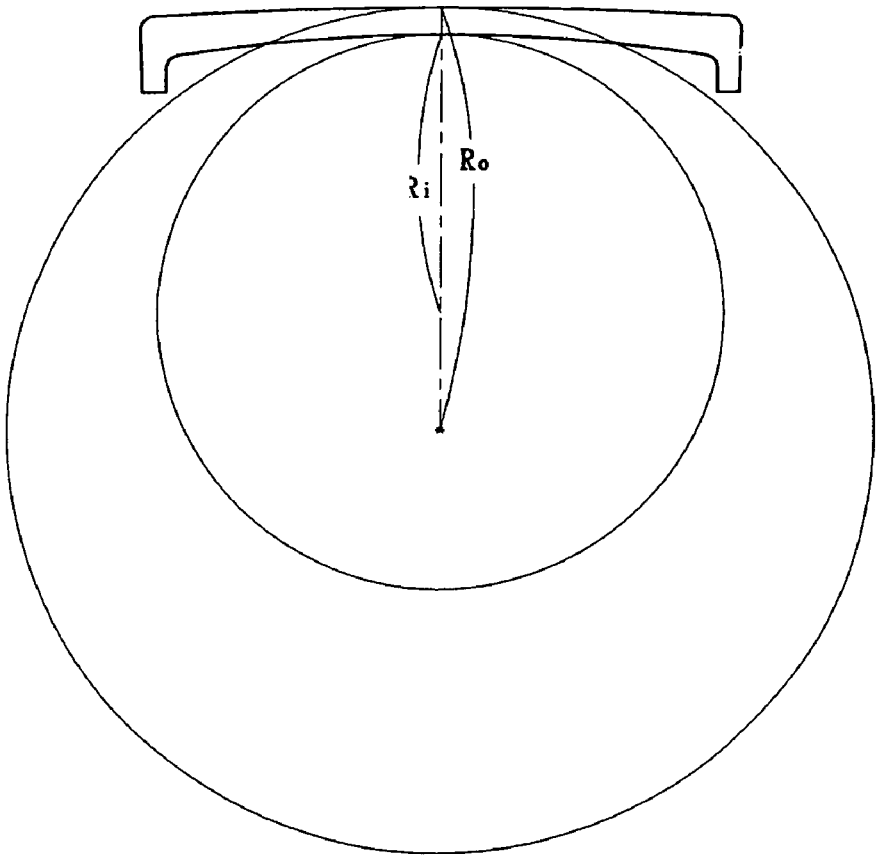

FIG. 3(*a*) shows a plane view of panel according to the present invention, and FIG. 3(*b*) shows a cross-section view of the panel according to the present invention. As shown in FIG. 3(*a*) and FIG. 3(*b*), shape of the panel of the cathode ray tube is rectangular shape. The panel comprises an inner surface, an outer surface and a diagonal portion where predetermined curvature is formed respectively. The outer surface of the panel is substantially plane. As shown in FIG. 3(*a*) and FIG. 3(*b*), Ro is radius of curvature of the outer surface of the panel, and Ri is radius of curvature of the inner surface of the panel.

Hereinafter, the cathode ray tube structure is described by utilizing the following names or terminologies.

Figure 4:
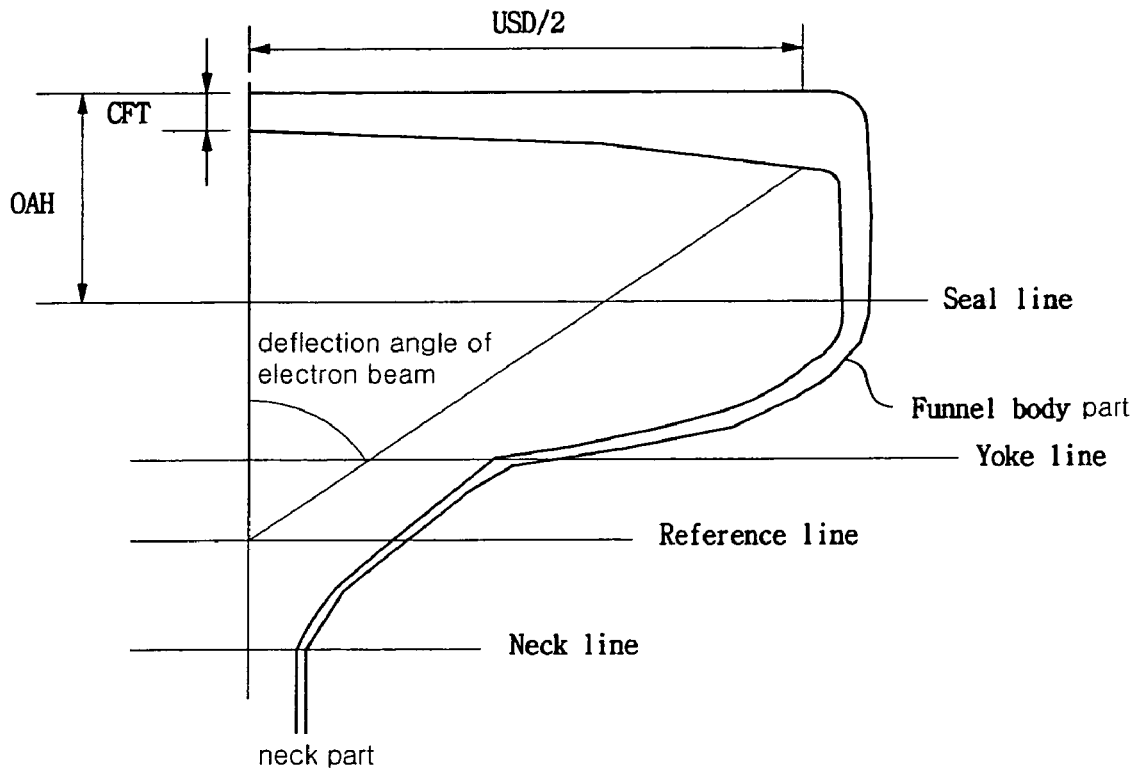
FIG. 4 is a drawing for explaining the names, length and thickness.

FIG. 4 is a drawing for explaining the names, length and thickness.

As shown in FIG. 4, A seal line includes a closed line through which the panel and the funnel is sealed together. A yoke line includes a boundary line between a body and yoke portions of the funnel. A neck line includes a closed line through which the neck portion and the funnel is sealed together. A reference line is a center line of deflection of the electron beam. USD is diagonal length of effective screen of the panel. CFT is thickness of center portion of the panel. OAH is overall height of the panel measured along defrection axis X.

<First Embodiment>

According to an aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein radius of curvature of outer surface of said panel is in the range of 5000 mm to 100000 mm, and said panel satisfies: $1.0 \leqq (OAH*CFT)/USD \leqq 1.5$ wherein OAH is overall height of said panel measured along defrection axis X, USD is diagonal length of effective screen of said panel and CFT is thickness of center portion of said panel.

Further, the USD is 500 mm or below.

Further, the USD is in the range of 400 mm to 450 mm.

Further, the CFT is 10 mm or below.

Further, the CFT is in the range of 8 mm to 9 mm.

Further, the ratio of OAH and USD (OAH/USD) is 0.15 or below.

Further, the radius of curvature of outer surface of said panel Ro is in the range of 5000 mm to 30000 mm.

Further, said panel satisfies: ratio of Td and Tx (Td/Tx) is no less than 1.3; where Tx is thickness of said panel at an end of longer axis and Td is thickness of said panel at a corner of said panel.

Further, the Td is 24 mm or below.

Further, said panel satisfies: ratio of Td and Ty (Td/Ty) is 1.4 or below; where Ty is thickness of said panel at an end of shorter axis and Td is thickness of said panel at a corner of said panel.

Further, the radius of curvature of inner surface of said panel is 1800 mm or below.

Further, the light penetration rate at center portion of said panel is in the range of 45% to 75%.

Further, said panel has center blend and peripheral blend at longer sides, shorter sides, and outer corner portions of said panel and radius of curvature of the center blend R1 is no less than 20 mm, and radius of curvature of the peripheral blend is no less than 3 mm.

Further, the surface of the panel is coated by a material having a large X ray absorption coefficient.

Further, said material is one of SrO, BaO and ZnO.

Table 1 is the result of an experiment where stress was measured across the funnel for various values of length and thickness at each position of the funnel according to the present invention and stress values of the prior art. Wherein, Ro is in range of 5000 mm to 10000 mm.

TABLE 1

| | | OAH [mm] | CFT [mm] | USD [mm] | OAH/USD | OAH × CFT/USD | Tm [%] | Tm [%] | Vacuum stress [MPa] panel | Vacuum stress [MPa] funnel |
|---|---|---|---|---|---|---|---|---|---|---|
| Present invention | 1 | 55.9 | 8.4 | 406.7 | 0.137 | 1.155 | 83.7 | 61.8 | 5.7 | 5.2 |
| | 2 | 48.9 | 8.4 | 406.7 | 0.120 | 1.010 | 83.7 | 61.8 | 5.2 | 4.8 |
| | 3 | 57 | 9.5 | 406.7 | 0.140 | 1.331 | 82.8 | 58.8 | 6.0 | 5.3 |
| | 4 | 50 | 9.5 | 406.7 | 0.123 | 1.168 | 82.8 | 58.8 | 5.8 | 5.1 |
| | 5 | 58 | 10.5 | 406.7 | 0.143 | 1.497 | 81.9 | 56.1 | 5.6 | 5.1 |
| | 6 | 51 | 10.5 | 406.7 | 0.125 | 1.317 | 81.9 | 56.1 | 5.1 | 4.7 |
| Prior art | 1 | 63 | 10.5 | 406.7 | 0.155 | 1.627 | 81.5 | 56.1 | 6.5 | 5.8 |
| | 2 | 63 | 10.5 | 406.7 | 0.155 | 1.627 | 81.5 | 56.1 | 6.6 | 5.7 |

As shown in Table 1, CFT in the present invention is smaller than 10.5 mm, CFT in the prior art, and OAH in the present invention is smaller than OAH in the prior art. Furthermore, each of OAH/USD and (OAH*CFT)/USD in the present invention is smaller than each of OAH/USD and (OAH*CFT)/USD in the prior art.

That is, in order to prevent breakness of the cathode ray tube by the outer shock and decrease weight of the panel, the (OAH*CFT)/USD is in the range of 1.0 to 1.5. When the (OAH*CFT)/USD is less than 1.0, characteristic of explosion proof in accordance with structral strength and the outer shock of the panel grows worse because reduction of the OAH and the CFT is too much. When the (OAH*CFT)/USD is more than 1.5, on account of difficulty of lightness of the weight of the cathode ray tube, cost of materials and rate of breakness of the cathode ray tube is increased, and yield of the cathode ray tube is decreased.

In order to prevent breakness of the cathode ray tube and embody lightness of weight of the cathode ray tube, the USD is 500 mm or below in the present invention. When permission error of design of the panel is considered, the USD in the present invention is in the rage of 400 mm to 450 mm.

In the present invention, the CFT is 10 mm or below. When permission error of design of the panel and decrease of cost of materials are considered, the CFT is in the range of 8 mm to 9 mm.

The OAH/USD is 0.15 or below in the present invention.

In accordance with decrease of the CFT, wedge ratio of the panel is increased. Therefore, brightness uniformity of screen and yield of the cathode ray tube are decreased.

Figure 5:
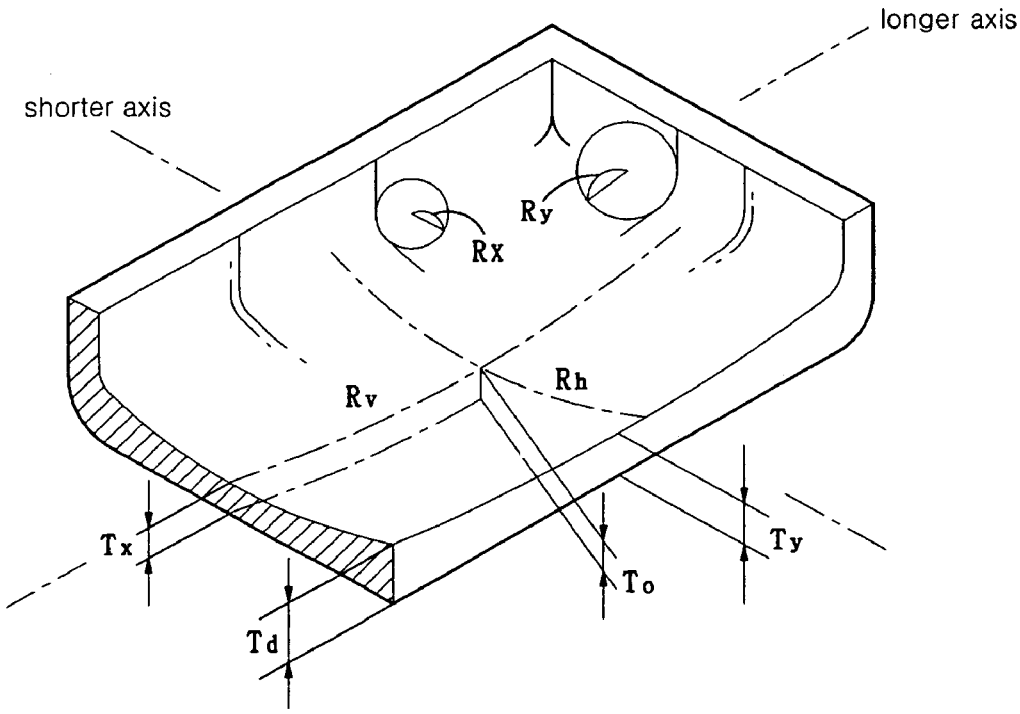
FIG. 5 shows wedge ratio in accordance with shape of the panel.

FIG. 5 shows wedge ratio in accordance with shape of the panel. As shown in FIG. 5, thickness of center of the panel in the present invention is less than thickness of edge portion of the effective screen. At this time, the outer surface of the panel is substantially plane, and predetermined curvature of the inner surface of the panel is formed.

Rh is a curvature of inner surface of the panel in a direction of longer axis. Rv is a curvature of inner surface of the panel in a direction of shorter axis. Rx is a curvature of inner surface of a longer side portion of the panel. Ry is a curvature of inner surface of a shorter side portion of the panel. To is a thickness of a center portion of the panel. Td is thickness of the panel at a corner of the panel. Tx is a thickness of the panel at an end of longer axis. Ty is a thickness of the panel at an end of shorter axis. The wedge ratio of the panel is Td/To.

Table 2 is for comparing wedge ratio in accordance with a panel structure in the present invention to wedge ratio in accordance with a panel structure in the prior art.

TABLE 2

| | | Tx [mm] | Ty [mm] | Td [mm] | Ty/Tx | Td/Tx | Td/Ty | Td/To |
|---|---|---|---|---|---|---|---|---|
| Present invention | 1 | 13.89 | 14.06 | 19.55 | 1.01 | 1.41 | 1.39 | 2.33 |
| | 2 | 13.89 | 14.06 | 19.55 | 1.01 | 1.41 | 1.39 | 2.33 |
| | 3 | 14.99 | 15.16 | 20.65 | 1.01 | 1.38 | 1.36 | 2.17 |
| | 4 | 14.99 | 15.16 | 20.65 | 1.01 | 1.38 | 1.36 | 2.17 |
| | 5 | 15.99 | 16.16 | 21.65 | 1.01 | 1.35 | 1.34 | 2.06 |
| | 6 | 15.99 | 16.16 | 21.65 | 1.01 | 1.35 | 1.34 | 2.06 |
| Prior art | 1 | 18.90 | 15.27 | 23.70 | 0.81 | 1.25 | 1.55 | 2.26 |
| | 2 | 17.59 | 14.54 | 21.65 | 0.83 | 1.23 | 1.49 | 2.06 |

As shown in Table 2, the wedge ratio of the panel in the present invention is more than the wedge ratio of the panel in the prior art. Increase of the wedge ratio causes decrease of brightness uniformity and yield in the heat process and deteriorates of quality of the cathode ray tube. These problems to be solved, the Ro is in the range of 5000 mm to 30000 mm. The reason why the Ro is in the range of 5000 mm to 30000 mm is that the less the radius of the curvature of the outer surface of the panel is, the less there is almost not difference of brightness between the center portion and peripheral portion of the panel.

At this time, Td/Tx is no smaller than 1.3. Td is 24 mm or below, and Td/Ty is 1.4 or below. In the shape of the panel of the present invention, Rh is less than Rv.

Meanwhile, there is a space between the panel and the shadow where apertures is formed. Therefore, when the radius of the curvature of the inner surface of the panel increases, structral strength of the shadow mask weakens. This problem to be solved, the Rx is more than Ry for increase of the structral strength. At this time, radius of the inner surface at corners of the panel Rdi is more than Rx, and is less than Ry. The Rdi is 1800 mm or below.

Furthermore, contrast characteristic changes of the cathode ray tube according to beam penetration ratio Tm. Glass of which beam penetration ratio is high is called a clear glass, and glass of which beam penetration ratio is low is called a tint glass.

That is, in despite of difference of brightness characteristic and contrast characteristic of the tint glass and the clear glass, condition of the panel in the present invention is applied to the clear glass and the tint glass. When manufacturing cost and production yield are considered, the tint glass is preferred to the clear glass in the present invention. The Tm of The tint glass is in the range of 45% to 75%.

According to the embodiment 1, because rest of length and thickness of the panel in rest part except of the USD is decreased, weight of the panel of the present invention decrease and the yield of the panel of the present invention increase. Furthermore, the yield of the cathode ray tube is improved by decrease of the breakness of the cathode ray tube in the heat process through optimization of construct of the panel and the funnel.

Figure 6:
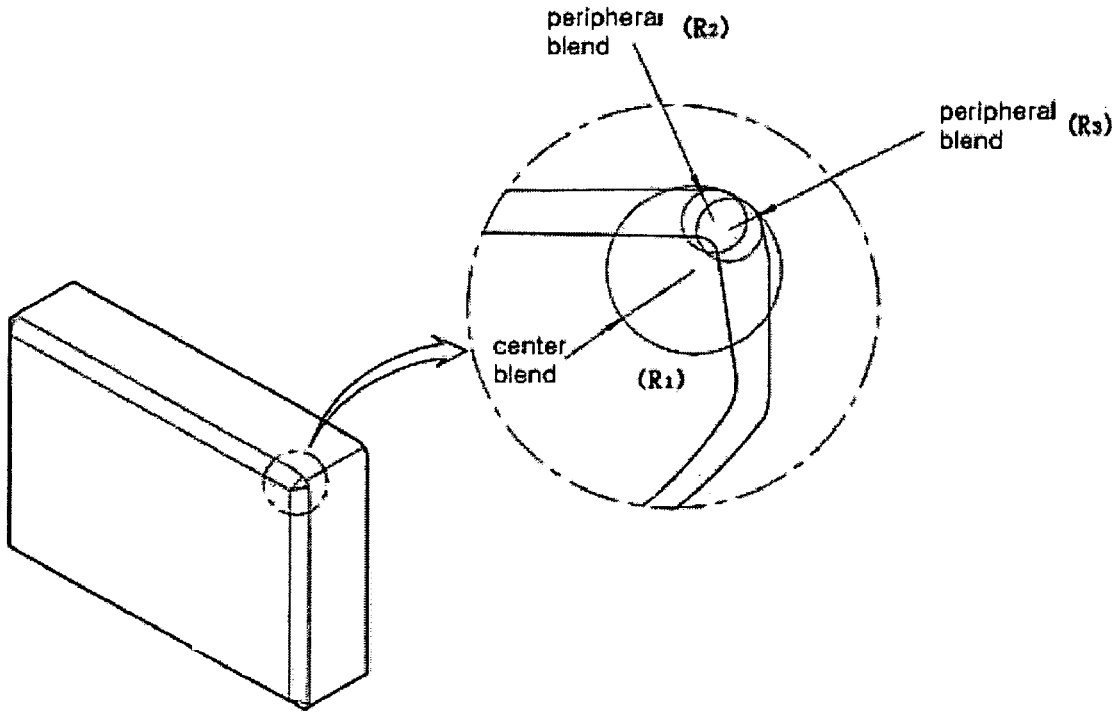
FIG. 6 is a drawing for showing radius of curvature at the longer side portion, the shorter side portion, and outer surface of the coner of the panel.

FIG. 6 is a drawing for showing radius of curvature at the longer side portion, the shorter side portion, and outer surface of the coner of the panel.

Generally, because stress is concentrated at the longer side portion, the shorter side portion, and outer surface of the coner of the panel, the panel is easily broken by the outer shock. As shown in FIG. 6, blend part is formed at curvature portion of coner of the outer surface of the longer side portion of the panel, curvature portion of coner of the outer surface of the shorter side portion of the panel and curvature portion of coner of the outer surface of the coner portion of the panel. The blend part comprises plural curvatures. At this time, the blend part is formed such that the blend part does not invade the inner side of the effective screen of the panel.

The blend portion comprises a center blend and a peripheral blend, and each blend of the center blend and the peripheral blend is a predetermined curvature. In detail, radius R1 of the curvature of the center blend is no less than 20 mm, radius R2 and R3 of the curvature of the peripheral blends are no less than 3 mm.

The blend part causes decrease of weight of the panel and prevents of concentration of the stress because the blend part is formed at the longer side portion, the shorter side portion, and the coner portion of the panel. Therefore, the structural strength is increased.

Instead, when the weight of the panel is decreased, after the evacuating process, vacuum stress is increased. The vacuum stress in the present invention the tensile stress between the tensile stress and the compression tensile which are generated in the evacuating process. Furthermore, according to decrease of the thickness of the panel, an ability of interception of the X-ray grows worse.

These problem to be solved, a compression stress layer is formed in the present invention. The compression stress layer comprises a material which has large absorption coefficient of the X-ray. At this time, thickness of the compression stress layer is no less than 30 μm, and an X-ray absorption material is an oxide including one material among SrO, BaO and ZnO.

As shown in Table. 1, the vacuum stress in the present invention is no more than vacuum stress in the prior art. Therefore, a shockproof is increased, and the breakness of the cathode ray tube is prevented. Furthermore, the X-ray is efficiently intercepted.

<Second Embodiment>

According to another aspect of the present invention, a cathode ray tube comprises a panel on inner surface of which a phosphor screen is formed; a funnel joined to the panel; an electron gun generating electron beams; and a deflection yoke which is mounted within the funnel to deflect the electron beams, wherein radius of curvature of outer surface of said panel is in the range of 5000 mm to 100000 mm, and diagonal length of effective screen of said panel is in the range of 450 mm to 500 mm, and said panel satisfies: $1.0 \leqq (OAH*CFT)/USD \leqq 1.7$ where OAH is overall height of said panel measured along defrection axis X, USD is diagonal length of effective screen of said panel and CFT is thickness of center portion of said panel.

Further, the CFT is 10 mm or below.

Further, the CFT is in the range of 8 mm to 9 mm.

Further, ratio of OAH and USD (OAH/USD) is 0.17 or below.

Further, radius of curvature of outer surface of said panel Ro is in the range of 5000 mm to 30000 mm.

Further, said panel satisfies: ratio of Td and Tx (Td/Tx) is no less than 1.3; where Tx is thickness of said panel at an end of longer axis and Td is thickness of said panel at a corner of said panel.

Further, the Td is 24 mm or below.

Further, said panel satisfies: ratio of Td and Ty (Td/Ty) is 1.4 or below; where Ty is thickness of said panel at an end of shorter axis and Td is thickness of said panel at a corner of said panel.

Further, radius of curvature of inner surface of said panel is 1800 mm or below.

Further, light penetration rate at center portion of said panel is in the range of 45% to 75%.

Further, said panel has center blend and peripheral blend at longer sides, shorter sides, and outer corner portions of said panel and radius of curvature of the center blend R1 is no less than 20 mm, and radius of curvature of the peripheral blend is no less than 3 mm.

Further, surface of the panel is coated by a material having a large X ray absorption coefficient.

Further, said material is one of SrO, BaO and ZnO.

Table 3 is for comparing the vacuum compression stress in accordance with length and thickness at each position of the panel in the present invention to vacuum stress in the prior art. At this time, the Ro is in the range of 5000 mm to 10000 mm, and the USD is in the range of 450 mm to 500 mm.

TABLE 3

| | | OAH [mm] | CFT [mm] | USD [mm] | OAH/USD | OAH × CFT/USD | Tm [%] | Tm [%] | Vacuum stress [MPa] panel | Vacuum stress [MPa] funnel |
|---|---|---|---|---|---|---|---|---|---|---|
| Present invention | 1 | 65 | 8.4 | 457.2 | 0.142 | 1.194 | 83.7 | 61.8 | 6.6 | 5.4 |
| | 2 | 59 | 8.4 | 457.2 | 0.129 | 1.084 | 83.7 | 61.8 | 6.3 | 5.1 |
| | 3 | 64 | 9.5 | 457.2 | 0.140 | 1.330 | 82.8 | 58.8 | 6.9 | 5.7 |
| | 4 | 60 | 9.5 | 457.2 | 0.131 | 1.247 | 82.8 | 58.8 | 6.7 | 5.5 |
| | 5 | 65 | 10.5 | 457.2 | 0.142 | 1.493 | 81.9 | 56.1 | 6.4 | 5.5 |
| | 6 | 61 | 10.5 | 457.2 | 0.133 | 1.401 | 81.9 | 56.1 | 6.0 | 4.9 |

TABLE 3-continued

| | | OAH [mm] | CFT [mm] | USD [mm] | OAH/USD | OAH × CFT/USD | Tm [%] | Tm [%] | Vacuum stress [MPa] panel | Vacuum stress [MPa] funnel |
|---|---|---|---|---|---|---|---|---|---|---|
| Prior art | 1 | 78.5 | 11.0 | 457.2 | 0.173 | 1.901 | 81.5 | 54.8 | 7.2 | 5.9 |
| | 2 | 79 | 11.5 | 457.2 | 0.173 | 1.987 | 81.5 | 54.8 | 6.8 | 5.6 |

As shown in the table. 3, the CFT and the OAH of the panel in the present invention are smaller than the CFT and the OAH of a panel in the prior art.

The (OAH*CFT)/USD is in the range of 1.0 to 1.7. When the USD is in the range of 450 mm to 500 mm and the (OAH*CFT)/USD is less than 1.0, characteristic of explosion-proof in accordance with the structral strength and outernal shock grows worse. The reason why the characteristic of explosion-proof grows worse is that decrease of the OAH and the CFT are too much. When the (OAH*CFT)/USD is more than 1.7, on account of difficulty of lightness of the weight of the cathode ray tube, cost of materials and rate of breakness of the cathode ray tube are increased, and yield of the cathode ray tube is decreased.

In order to prevent breakness of the cathode ray tube and embody lightness of weight of the cathode ray tube, the CFT is no less than 10 mm. When permission error of design of the panel is considered, the CFT in the present invention is in the rage of 8 mm to 9 mm.

The OAH/USD is 0.17 or below in the present invention.

In accordance with decrease of the CFT, wedge ratio of the panel is increased. Therefore, brightness uniformity of screen and yield of the cathode ray tube are decreased.

Table 4 is for comparing wedge ratio (Td/To) in accordance with the panel structure in the present invention to wedge ratio in accordance with a panel structure in the prior art.

TABLE 4

| | | Tx [mm] | Ty [mm] | Td [mm] | Ty/Tx | Td/Tx | Td/Ty | Td/To |
|---|---|---|---|---|---|---|---|---|
| Present invention | 1 | 15.66 | 15.76 | 21.81 | 1.01 | 1.39 | 1.38 | 2.60 |
| | 2 | 15.66 | 15.76 | 21.81 | 1.01 | 1.39 | 1.38 | 2.60 |
| | 3 | 16.76 | 16.88 | 22.91 | 1.01 | 1.37 | 1.36 | 2.41 |
| | 4 | 16.76 | 16.88 | 22.91 | 1.01 | 1.37 | 1.36 | 2.41 |
| | 5 | 17.76 | 17.86 | 23.91 | 1.01 | 1.35 | 1.34 | 2.28 |
| | 6 | 17.76 | 17.86 | 23.91 | 1.01 | 1.35 | 1.34 | 2.28 |
| Prior art | 1 | 21.17 | 16.26 | 26.46 | 0.77 | 1.25 | 1.63 | 2.41 |
| | 2 | 21.67 | 16.76 | 26.96 | 0.77 | 1.24 | 1.61 | 2.34 |

As shown in Table 4, the wedge ratio of the panel in the present invention is more than the wedge ratio of the panel in the prior art. Increase of the wedge ratio causes decrease of brightness uniformity and yield in the heat process and deteriorates of quality of the cathode ray tube. These problems to be solved, the Ro is in the range of 5000 mm to 30000 mm. The reason why the Ro is in the range of 5000 mm to 30000 mm is that the less the radius of the curvature of the outer surface of the panel is, the less there is almost not difference of brightness between the center portion and peripheral portion of the panel.

At this time, Td/Tx is no less than 1.3. The Td is 24 mm or below, and Td/Ty is 1.4 or below. Therefore, like first embodiment, Rh is less than Rv.

Meanwhile, there is a space between the panel and the shadow mask where apertures is formed. Therefore, when the radius of the curvature of the inner surface of the panel increases, structral strength of the shadow mask weakens. This problem to be solved, the Rx is more than Ry for increase of the structral strength. At this time, radius of the inner surface at corners of the panel Rdi is more than Rx, and is less than Ry. The Rdi is 1800 mm or below.

Rest condition of the panel in the embodiment. 2 except for the USD, (OAH*CFT)/USD and OAH/USD is the same condition of the panel in the embodiment 1. Furthermore, means for intercepting the X-ray and preventing the vacuum stress from concentrating are the same means of the panel in the embodiment 1.

As shown in Table. 3, the vacuum stress in the present invention is no more than vacuum stress in the prior art. Therefore, a shockproof is increased, and the breakness of the cathode ray tube is prevented. Furthermore, the X-ray is efficiently intercepted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cathode ray tube comprising:

a panel on inner surface of which a phosphor screen is formed;

a funnel joined to the panel;

an electron gun generating electron beams; and a deflection yoke which is mounted within the funnel to deflect the electron beams, wherein a radius of curvature of an outer surface of said panel is in the range of 5000 mm to 100000 mm, and said panel satisfies: 1.0 mm≦(OAH*CFT)/USD≦1.5 mm where OAH is an overall height of said panel measured along a deflection axis X, USD is a diagonal length of an effective screen of said panel, CFT is a thickness of a center portion of said panel, and said panel satisfies: ratio of Td and Tx (Td/Tx) is no less than 1.3; where Tx is a thickness of said panel at an end of a longer axis and Td is a thickness of said panel at a corner of said panel.

2. The cathode ray tube of claim 1, wherein the USD is 500 mm or below.

3. The cathode ray tube of claim 2, wherein the USD is in the range of 400 mm to 450 mm.

4. The cathode ray tube of claim 1, wherein the CFT is 10 mm or below.

5. The cathode ray tube of claim 4, wherein the CFT is in the range of 8 mm to 9 mm.

6. The cathode ray tube of claim 1, wherein ratio of OAH and USD (OAH/USD) is 0.15 or below.

7. The cathode ray tube of claim 1, wherein radius of curvature of outer surface of said panel Ro is in the range of 5000 mm to 30000 mm.

8. The cathode ray tube of claim 1, wherein the Td is 24 mm or below.

9. The cathode ray tube of claim 1, wherein said panel satisfies: ratio of Td and Ty (Td/Ty) is 1.4 or below; where Ty is thickness of said panel at an end of shorter axis and Td is thickness of said panel at a corner of said panel.

10. The cathode ray tube of claim 1, wherein radius of curvature of inner surface of said panel is 1800 mm or below.

11. The cathode ray tube of claim 1, wherein light penetration rate at center portion of said panel is in the range of 45% to 75%.

12. The cathode ray tube of claim 1, wherein said panel has center blend and peripheral blend at longer sides, shorter sides, and outer corner portions of said panel and radius of curvature of the center blend R1 is no less than 20 mm, and radius of curvature of the peripheral blend is no less than 3 mm.

13. The cathode ray tube of claim 1, wherein surface of the panel is coated by a material having a predetermined X ray absorption coefficient.

14. The cathode ray tube of claim 13, wherein said material is one of SrO, BaO and ZnO.

15. A cathode ray tube comprising:

a panel on inner surface of which a phosphor screen is formed;

a funnel joined to the panel;

an electron gun generating electron beams; and a deflection yoke which is mounted within the funnel to deflect the electron beams, wherein said panel satisfies: 1.0 mm≦(OAH*CFT)/USD≦1.7 mm where OAH is an overall height of said panel measured along deflection axis X, USD is a diagonal length of an effective screen of said panel, CFT is a thickness of a center portion of said panel, and said panel satisfies: ratio of Td and Tx (Td/Tx) is no less than 1.3; where Tx is a thickness of said panel at an end of a longer axis and Td is a thickness of said panel at a corner of said panel.

16. The cathode ray tube of claim 15, wherein the CFT is 10 mm or below.

17. The cathode ray tube of claim 16, wherein the CFT is in the range of 8 mm to 9 mm.

18. The cathode ray tube of claim 15, wherein ratio of OAH and USD (OAH/USD) is 0.17 or below.

19. The cathode ray tube of claim 15, wherein radius of curvature of outer surface of said panel Ro is in the range of 5000 mm to 30000 mm.

20. The cathode ray tube of claim 15, wherein the Td is 24 mm or below.

21. The cathode ray tube of claim 15, wherein said panel satisfies: ratio of Td and Ty (Td/Ty) is 1.4 or below; where Ty is thickness of said panel at an end of shorter axis and Td is thickness of said panel at a corner of said panel.

22. The cathode ray tube of claim 15, wherein radius of curvature of inner surface of said panel is 1800 mm or below.

23. The cathode ray tube of claim 15, wherein light penetration rate at center portion of said panel is in the range of 45% to 75%.

24. The cathode ray tube of claim 15, wherein said panel has center blend and peripheral blend at longer sides, shorter sides, and outer corner portions of said panel and radius of curvature of the center blend R1 is no less than 20 mm, and radius of curvature of the peripheral blend is no less than 3 mm.

25. The cathode ray tube of claim 15, wherein surface of the panel is coated by a material having a predetermined X ray absorption coefficient.

26. The cathode ray tube of claim 25, wherein said material is one of SrO, BaO and ZnO.

* * * * *